United States Patent [19]

Kenney et al.

[11] 4,069,163

[45] Jan. 17, 1978

[54] LUBRICANT COMPOSITION

[75] Inventors: Harold E. Kenney, Jenkintown; Edward T. Donahue, Philadelphia, both of Pa.

[73] Assignee: The United States of America as represented by the Secretary of Agriculture, Washington, D.C.

[21] Appl. No.: 701,057

[22] Filed: June 30, 1976

[51] Int. Cl.[2] ..... C10M 1/48; C10M 3/42; C10M 5/24; C10M 7/46

[52] U.S. Cl. ..... 252/46.7; 252/389 A; 252/400 A; 260/125

[58] Field of Search ..... 252/46.7, 389 A, 400 A; 260/125

[56] References Cited

U.S. PATENT DOCUMENTS

| | | | |
|---|---|---|---|
| 2,116,472 | 5/1938 | Ralston | 260/125 |
| 2,416,807 | 3/1947 | Watkins | 252/46.7 |
| 2,419,153 | 4/1947 | Musselman et al. | 260/125 |
| 2,584,977 | 2/1952 | Bartleson | 252/46.7 |
| 2,830,023 | 4/1958 | Hoare | 260/125 |

*Primary Examiner*—Delbert E. Gantz
*Assistant Examiner*—Irving Vaughn
*Attorney, Agent, or Firm*—M. Howard Silverstein; William E. Scott; David G. McConnell

[57] ABSTRACT

Lubricant compositions which exhibit excellent anti-wear, corrosion, and oxidative thermal properties are prepared by adding from 0.06 to 2.0% of a partial phosphorous pentasulfide adduct of a polycyanoethylated keto fatty ester to a base oil. The base oil may be either a synthetic diester oil or a standard test petroleum oil such as paraffin mineral oil.

10 Claims, No Drawings

LUBRICANT COMPOSITION

BACKGROUND OF THE INVENTION

1. Field of the Invention

This invention relates to lubricant additives and more particularly to partial phosphorus pentasulfide adducts of polycyanoethylated keto fatty ester as lubricant additives and to lubricant compositions containing these esters.

2. Description of the Prior Art

The cyanoethylated keto fatty esters are known to impart anti-wear properties to different base oils, U.S. Pat. Nos. 3,836,468 and 3,832,368. Phosphorus pentasulfide is also well known in the lubrication field, although it is mainly used in low temperature antifriction applications.

SUMMARY OF THE INVENTION

An object of this invention is to provide lubricants which have above average anti-wear and oxidative thermal properties when formulated with synthetic diester oils and lubricants that have above average anitwear, corrosion, and oxidative thermal properties when formulated with petroleum oils.

Another object of this invention is to provide lubricants which are noncorrosive and which have good rust inhibiting properties.

According to this invention the above objects are accomplished by lubricant compositions which contain a major proportion of a base lubricating oil and from about 0.06 and to about 2.0 weight percent of an additive that is a partial phosphorus pentasulfide adduct of a polycyanoethylated keto fatty ester.

The phosphorus pentasulfide adduct is prepared by reacting a keto fatty ester with acrylonitrile and reacting the resultant polycyanoethylated keto fatty ester with phosphorus pentasulfide until about one-half of the cyanoethyl groups are reacted with the phosphorus pentasulfide. The keto fatty ester may be a pure compound or it may be a mixture of ketostearates or keto esters.

The commonly used base lubricating oils such as di-(2-ethylhexyl) sebacate (DOS), dipropylene glycol diperlargonate (DPDP), di-iso-octyl azelate (DIOA), di-(2-ethylhexyl) azelate (DOA), and paraffin mineral oil (Standard test petroleum oil), are compatible for use in preparing the lubricant compositions of this invention.

DETAILED DESCRIPTION OF THE INVENTION

Lubricant compositions formulated by the addition of the phosphorus pentasulfide adducts of this invention to the commonly used synthetic diester base oils demonstrate excellent antiwear and oxidative thermal properties. Lubricants formulated by the addition of the phosphorus pentasulfide adducts of this invention to a standard test petroleum oil such as paraffin mineral oil have good anti-wear, corrosion, and oxidative thermal properties.

The lubricant compositions of this invention contain at least 98% of a commonly used base oil such as the synthetic diester oils or a standard test petroleum oil and from 0.06% to about 2% of partial phosphorus pentasulfide of adducts of polycyanoethylated keto fatty esters. The keto fatty ester molecules contain from one to four cyanoethyl groups. When used in either diester or petroleum based oils, the phosphorus pentasulfide adducts of this invention are noncorrosive to copper, and exhibit particularly good rust inhibiting properties when formulated with the diester base oils. The adducts are soluble in a wide range of base oils and are especially soluble in the diester type lubricating oils.

In view of the fact that compounds obtained by fully reacting the cyano groups with phosphorus pentasulfide were found to be unacceptably corrosive and exhibited relatively poor solubility and wear properties, it was quite surprising and unexpected to discover that the adducts in which only about half of the cyano groups were reacted with the phosphorus pentasulfide exhibited such excellent properties as lubricant additives.

Lubricant compositions of this invention are uniquely adapted for the new long-lasting automotive crankcase lubricants because of their excellent oxidative and thermal stability. Since only small amounts of additives are needed to obtain good anti-wear properties, the cost/performance ratio is very good. Thus, the additives and lubricant compositions of this invention are economically very competitive with available products.

The novel adducts of this invention, because of their low cost and their excellent lubricant additive properties, are good candidates as additives to transmission fluids, compressor lubricants, metal working fluids, and gear lubricants.

Anti-wear properties were determined using the Shell Four Ball Wear Tester as described by ASTM designation D2266-64T and the Federal test method standard No. 7916. Approximately 10 ml. of the oil to be tested is placed in the test cup so that the three bottom stationary balls are covered. After positioning the cup on its stand in contact with the fourth ball, the grease is heated to 120°, a 50 kg. load is placed on the weight tray, and the upper ball is allowed to rotate at 600 r.p.m. for one hour. The diameters of the scars worn on the three stationary balls are measured by means of a low power microscope.

The corrosion tests were run using the ASTM D130 method.

Thermal-Oxidation Stability was determined using the Beaker Oven Test. This test is performed by placing a blend of 0.5% of the additive in the base oil in a small beaker. The solution is exposed to air in an oven at 150° C until a sludge forms on the glassware. The time is measured in days. If the mixture is free of sludge for five days or longer, it is considered to be stable under crankcase oil conditions.

The invention is illustrated by the following examples:

EXAMPLE 1

Fifty grams (0.186 moles) of methyl 12-ketostearate was dissolved in 336 g. (6.3 moles) of acrylonitrile containing 8 ml. water. To this mixture was added with stirring, 24 ml. of a 40% aqueous solution of benzyltrimethylammonium hydroxide. The mixture was stirred for 1 hour and then diluted with 300 ml. of water and 200 ml. of acetone. The mixture was acidified with HCl and extracted with three 400 ml. portions of ether. The combined extracts were washed with water, dried over sodium sulfate, and evaporated to a residue weight of 68.4 g. Gas-liquid chromatography (GLC), thin-layer chromatography (TLC), and infrared (IR) analysis confirmed that the residue was predominately a mixture of mono, di, tri, and tetra cyanoethylated ketostearate isomers plus some unreacted ketostearate. Recrystallization from hexane removed the unreacted ketostearate. GLC and elemental analysis showed the recrystallized product averaged about two cyanoethyl groups per molecule. The polycyanoethyl keto fatty ester thus prepared was then reacted with phosphorus pentasulfide at an approximate molar ratio of 7:1 by heating for about one hour at about 100° C, with stirring, to yield the partial phosphorus pentasulfide adduct. As determined by gas chromatographic and infrared analysis, about one-half of the cyanoethyl groups reacted with the $P_2S_5$. The chemical structure of the adduct is very complex and has not yet been determined.

EXAMPLE 2

A polycyanoethyl keto fatty ester prepared as in Example 1 from a mixed keto ester containing about 85% methyl 9,10-ketostearate and about 15% of ketones varying in carbon chain length from 14 to 20 was reacted with $P_2S_5$ as in Example 1 to yield the partial phosphorus pentasulfide adduct. As determined by gas chromatographic and infrared analyses, about one-half of the cyanoethyl groups reacted with the $P_2S_5$.

Corrosions test and wear data of lubricants made by adding the partial phosphorus pentasulfide adduct of Example 1 to base oils are shown in Tables I and II. The percentage of adduct in the base oil as shown is on a weight basis.

Corrosion test, oxidative thermal stability, and wear data of lubricants made by adding the partial phosphorus pentasulfide adduct of Example 2 to base oils are shown in Tables III and IV. As in Example 1, the percentages are on a weight basis.

Table I

| Base Oil[1/] | Corrosion Data<br>Test Result[b/] |
|---|---|
| di(2 ethylhexyl)sebacate(DOS) | 1a |
| dipropylene glycol dipelargonate (DPDP) | 2e |
| di-iso-octyl azelate (DIOA) | 2b |
| di-(2-ethylhexyl) azelate (DOA) | 1b |
| Petroleum Oil | 1a |

[a/] contains 0.5% partial $P_2S_5$ adduct
[b] ASTM copper strip corrosion standards method D 130

Table II

| Base Oil | Neat | 2% | 1% | Wear Data[a/]<br>0.67% | 0.5% | 0.25% | 0.12% | 0.06% |
|---|---|---|---|---|---|---|---|---|
| D.O.S. | 0.963 | 0.473 | 0.413 | — | 0.430 | 0.495 | 0.966 | — |
| DPDP | 0.743 | — | Insol | 0.560 | 0.580 | 0.603 | 0.738 | — |
| DIOA | 0.868 | — | — | Insol | 0.473 | 0.423 | 0.455 | 0.590 |
| DOA | 0.902 | — | — | Insol | 0.520 | 0.413 | 0.460 | 0.540 |
| Pet Oil | 0.806 | — | 0.523 | — | 0.562 | 0.822 | — | — |

[a/]Wear Scar Diameter in mm.

Table III

| Base Oil[a/] | Corrosion Data and Oxidative Thermal Stability<br>Corrosion Test[b/] | Oxidative Thermal Stability[c/] |
|---|---|---|
| | | Days |
| Petroleum Oil | 1a | 4 |
| di(2 ethylhexyl) sebacate(DOS) | 1a | 7 |
| dipropylene glycol-dipelargonate (DPDP) | 1b | 7 |

[a/]Contains 0.5% partial $P_2S_5$ adduct.
[b/]ASTM copper strip corrosion standards method D 130.
[c/]Beaker oven Test.

Table IV

| Base Oil | Neat | 2% | Wear Data[a/]<br>1% | 0.5% | 0.25% | 0.12% |
|---|---|---|---|---|---|---|
| Pet Oil | 0.806 | 0.536 | 0.495 | 0.548 | 0.766 | — |
| DOS | 0.963 | 0.452 | 0.418 | 0.436 | 0.483 | 0.958 |
| DPDP | 0.743 | Insol. | 0.558 | 0.597 | 0.610 | 0.700 |

[a/]Wear Scar Diameter in mm.

We claim:

1. A lubricant composition comprising a major proportion of a lubricating oil to which has been added from about 0.06 to about 2.0 weight percent of an additive which is a partial phosphorus pentasulfide adduct of a polycyanoethylated keto fatty ester, said adduct prepared by reacting a keto fatty ester selected from the group consisting of methyl-12-ketostearate and a mixed keto ester containing about 85% of methyl 9,10-ketostearate and about 15% of ketones having from 14 to 20 carbon atoms in their chain lengths with acrylonitrile and then reacting the resultant polycyanoethylated keto fatty ester with phosphorus pentasulfide at a molar ratio of about 7 to 1, respectively, at about 100° C for about 1 hour until about one-half of the cyanoethyl groups are reacted.

2. A lubricant composition as in claim 1 wherein the keto fatty ester is methyl 12-ketostearate.

3. A lubricant composition as in claim 1 wherein the keto fatty ester is a mixture containing about 85% methyl, 9,10-ketostearate and about 15% of ketones having carbon chain lengths of from 14 to 20.

4. A lubricant composition as in claim 1 wherein the lubricating oil is di-(2-ethylhexyl) sebacate.

5. A lubricant composition as in claim 1 wherein the lubricating oil is dipropylene glycol dipelargonate.

6. A lubricant composition as in claim 1 wherein the lubricating oil is di-iso-octyl azelate.

7. A lubricant composition as in claim 1 wherein the lubricating oil is di-(2-ethylhexyl) azelate.

8. A lubricant composition as in claim 1 wherein the lubricating oil is a paraffin mineral oil.

9. A lubricant additive comprising the product of the reaction of a polycyanoethyl keto fatty ester and phosphorus pentasulfide wherein only about one-half of the cyanoethyl groups of the keto ester are reacted, said polycyanoethyl keto fatty ester having been prepared by reacting a keto fatty ester selected from the group consisting of methyl-12-ketostearate and a mixed keto ester containing about 85% of methyl 9,10-ketostearate and about 15% of ketones having from 14 to 20 carbon atoms in their chain lengths with acrylonitrile.

10. The additive of claim 9 wherein the keto ester and the pentasulfide are present in the reaction at a 7:1 molar ratio.

* * * * *